US009752435B2

(12) United States Patent
Venter

(10) Patent No.: US 9,752,435 B2
(45) Date of Patent: Sep. 5, 2017

(54) MINE ROOF SUPPORT

(71) Applicant: Saltus Poles CC, Vanderbijlpark (ZA)

(72) Inventor: Johann Adriaan Venter, Three Rivers (ZA)

(73) Assignee: SETEVOX (PTY) LTD, Menlo Park (ZA)

( * ) Notice: Subject to any disclaimer, the term of this patent is extended or adjusted under 35 U.S.C. 154(b) by 0 days.

(21) Appl. No.: 14/417,119

(22) PCT Filed: Jul. 22, 2013

(86) PCT No.: PCT/ZA2013/000053
§ 371 (c)(1),
(2) Date: Jan. 23, 2015

(87) PCT Pub. No.: WO2014/018993
PCT Pub. Date: Jan. 30, 2014

(65) Prior Publication Data

US 2015/0204192 A1 Jul. 23, 2015

(30) Foreign Application Priority Data

Jul. 23, 2012 (ZA) ..... 2012/05524

(51) Int. Cl.

| | |
|---|---|
| ***E21D 15/55*** | (2006.01) |
| ***E21D 15/00*** | (2006.01) |
| ***E21D 15/02*** | (2006.01) |
| ***E21D 15/502*** | (2006.01) |

(52) U.S. Cl.
CPC ..... *E21D 15/005* (2013.01); *E21D 15/02* (2013.01); *E21D 15/502* (2013.01)

(58) Field of Classification Search
CPC ..... E21C 27/24; E21C 25/58; E21C 41/16; E21C 25/00; E21D 9/1093; E21D 11/00; E21D 13/00; E21D 15/55; E21D 15/483; E21D 15/545; E21D 23/00; E21D 23/0418; E21D 23/063; E21D 23/066; E21D 23/0034; E21D 23/081; E21D 23/088; E21D 23/10; E21D 23/12
USPC .... 405/146, 150.1, 151, 288, 289, 290, 291, 405/292, 293, 294, 295, 296, 297, 298, 405/299, 300, 301, 302; 299/30, 33, 64, 299/67, 68, 77, 78
See application file for complete search history.

(56) References Cited

U.S. PATENT DOCUMENTS

| | | | | |
|---|---|---|---|---|
| 1,821,850 | A * | 9/1931 | Riemenschneider | E04H 12/08 138/173 |
| 3,041,702 | A * | 7/1962 | Schwab | B28B 23/024 249/93 |
| 3,297,292 | A * | 1/1967 | Friedrich-Wilhelm | E21D 11/02 248/354.6 |
| 3,805,533 | A * | 4/1974 | Askey | F16B 13/141 405/259.6 |

(Continued)

FOREIGN PATENT DOCUMENTS

| | | |
|---|---|---|
| DE | 10 61 724 B | 7/1959 |
| EP | 0 128 964 A1 | 12/1984 |

(Continued)

*Primary Examiner* — Benjamin Fiorello
*Assistant Examiner* — Edwin Toledo-Duran
(74) *Attorney, Agent, or Firm* — Knobbe Martens Olson & Bear, LLP

(57) ABSTRACT

A yielding mine roof support is provided which is made in the form of a hollow tube made from an epoxy, phenolic, or polyester fiberglass composite.

17 Claims, 3 Drawing Sheets

(56) References Cited

U.S. PATENT DOCUMENTS 3,818,710 A * 6/1974 Chlumecky ..... 405/152
4,101,230 A * 7/1978 Moe ..... B63B 9/065 403/171
4,122,682 A * 10/1978 Groetschel ..... E21C 35/00 299/11
4,534,531 A * 8/1985 Brown ..... E21D 15/02 248/351
4,712,947 A * 12/1987 Thom ..... E21D 15/02 248/351
4,939,037 A * 7/1990 Freeman ..... B29D 23/00 138/130
5,176,180 A * 1/1993 Williams ..... F16L 9/006 138/121
5,400,994 A * 3/1995 Shawwaf ..... E21D 15/22 248/354.3
5,908,049 A * 6/1999 Williams ..... E21B 17/206 138/125
6,655,877 B2 * 12/2003 Calhoun ..... E21D 15/22 248/542
6,698,843 B2 * 3/2004 Mraz ..... E21C 25/58 198/303
6,869,147 B2 * 3/2005 Drake ..... E21B 7/002 299/1.3
6,910,834 B2 * 6/2005 Harbaugh ..... E21D 15/55 248/351
6,953,307 B2 * 10/2005 Graham ..... F16L 55/28 166/242.2
2009/0297278 A1 * 12/2009 Tsukamoto ..... E21D 21/0006 405/259.1
2010/0047489 A1 * 2/2010 Cesternino ..... E04C 3/29 428/34.1
2010/0119820 A1 * 5/2010 Ultsch ..... 428/343
2012/0128444 A1 5/2012 Podesser et al.
2012/0141706 A1 * 6/2012 Bocquet ..... E04B 1/2604 428/35.6

FOREIGN PATENT DOCUMENTS

GB 2 096 203 A 10/1982
WO WO 2012/016272 A1 2/2012

* cited by examiner

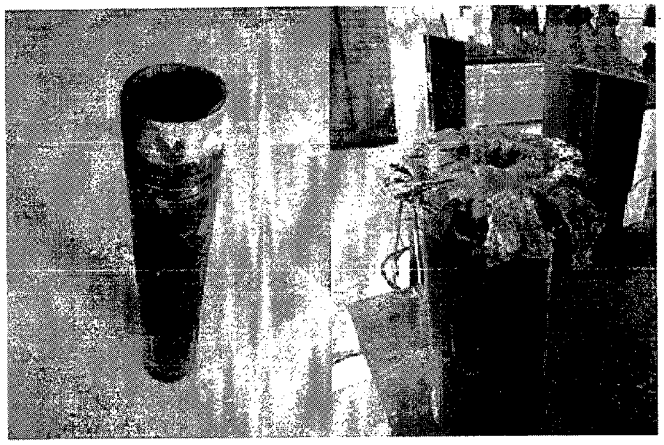
Figure 2: Mode of safe yielding at design load (before and after)
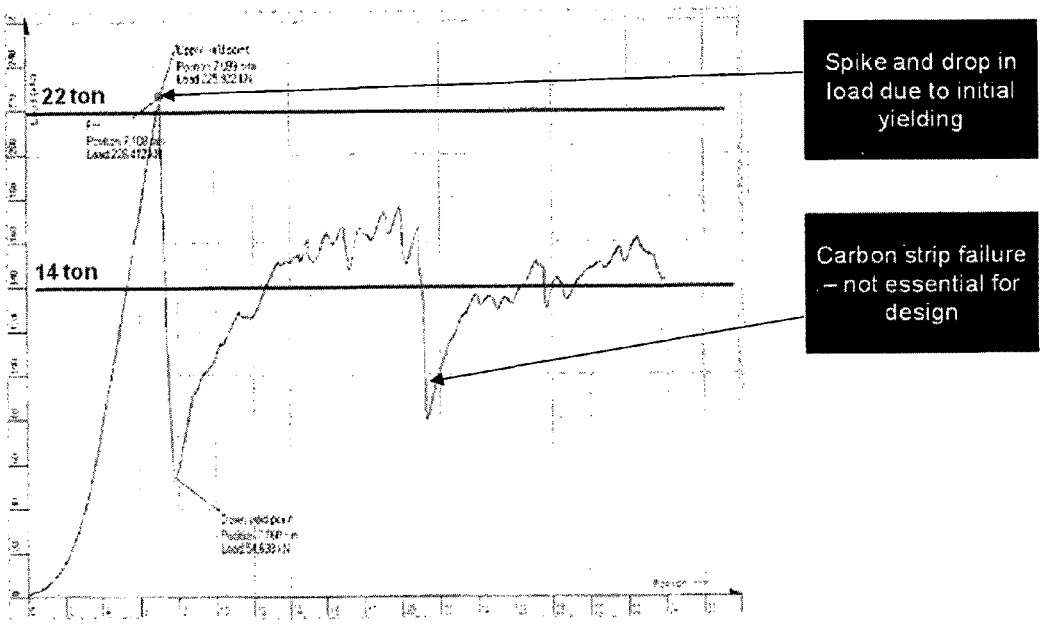
Figure 3: Initial drop in load unwanted from a yielding unit

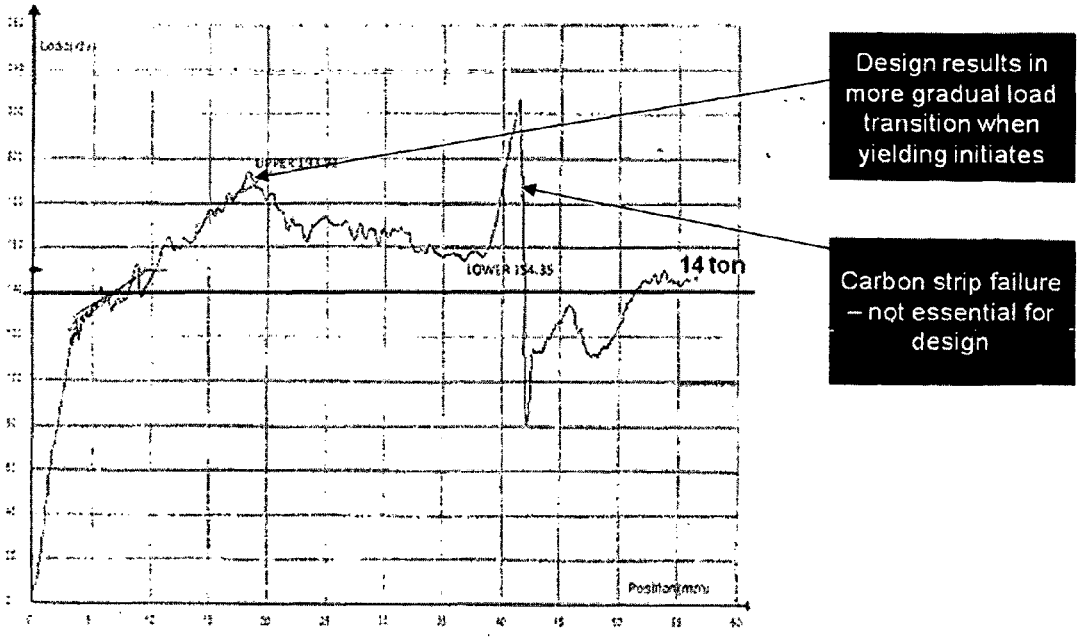
Figure 4: New tapered design removes initial drop in load
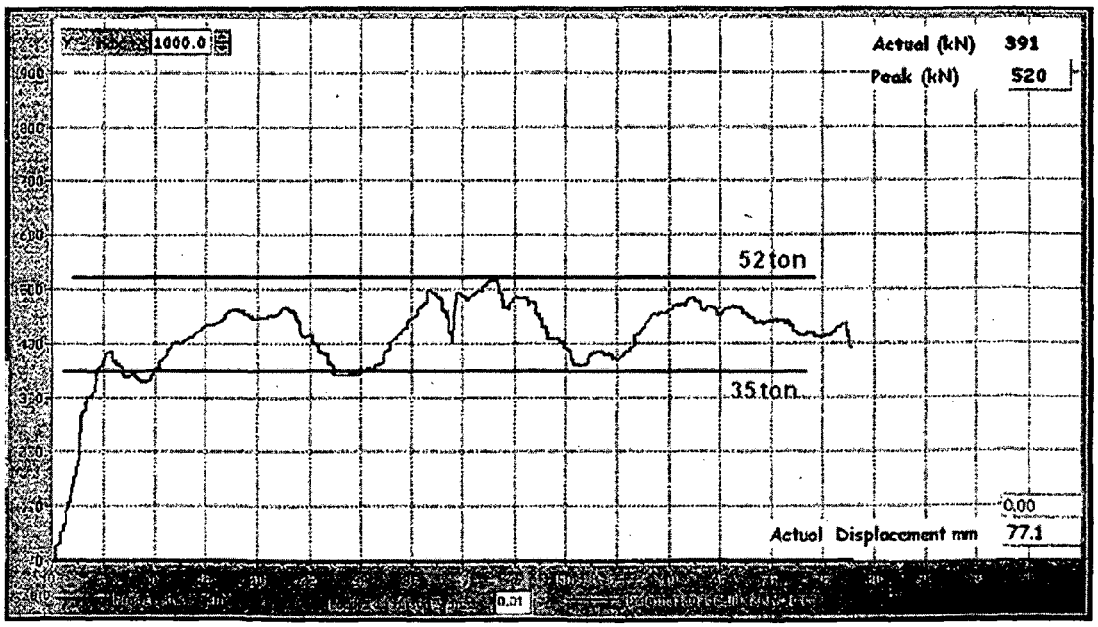
Figure 5: New tapered design for a 40 ton support (modifying the taper resulted in subsequent tests varying between 40 and 50 tons)

MINE ROOF SUPPORT

INCORPORATION BY REFERENCE TO RELATED APPLICATIONS

Any and all priority claims identified in the Application Data Sheet, or any correction thereto, are hereby incorporated by reference under 37 CFR 1.57. This application is the national phase under 35 U.S.C. §371 of prior PCT International Application No. PCT/ZA2013/000053 which has an International Filing Date of Jul. 22, 2013, which designates the United States of America, and which claims priority to South Africa Application No. ZA 2012/05524 filed Jul. 23, 2012. Each of the aforementioned applications is incorporated by reference herein in its entirety, and each is hereby expressly made a part of this specification.

FIELD OF THE INVENTION

The invention relates to yielding mine roof supports.

BACKGROUND OF THE INVENTION

Many alternative support beams, mine props or mine pillars have been designed to replace the wooden support beam or reinforce the wooden support beam, but usually the high cost prevents it from entering the market. U.S. Pat. No. 4,712,947 disclose a timber load support member and a sleeve surrounding the support member in its axial direction. The timber prop had an initial length of 1200 mm with the surrounding sleeve made from mild steel being 900 mm long with a wall thickness of 2.8 mm. The timber fibres of the prop began to progressively separate in the direction transverse to the prop axis at around 30 mm and was fully load supporting at around 280 mm after a 23% reduction in length and around 60 tons of load. Quite a large displacement of wood or un-controlled yielding is seen over the length of the prop weakening the support beam with cracked fibres that can be seen at the head and foot part of the prop being held together by the relative expensive, heavy steel sleeve.

U.S. Pat. No. 6,910,834 disclose a mine support prop comprised of an outer steel shell formed in the shape of an elongate tube. An aerated or other lightweight concrete or cement is poured into the elongate tube to substantially fill the entire length of the tube. The total weight of the prop is 58 kg, has a length of 2 m, width of 150 mm and the sleeve diameter is 2 mm. A plurality of elongate steel support members having a length less than the elongate tube are attached to the tube to prevent buckling of the elongate tube along the portion of the tube to which the support members are attached. Buckling is more prone to happen with a relative high (>10) slenderness ratio (height to width ratio) when an elongate tube is exposed to sufficient axial force and therefore the use of the steel support members in the above specification. The elongate tube may be formed by fibreglass formation but no reference is made in the specification to its thickness, specific fibre orientation or that its required length may be less than the entire length of the tube. The mine prop can support a load above 22 tons until more than 175 mm of displacement have occurred. A high slenderness ratio prop is of benefit to the mines as they convey these props down the mine in the same "cart" as what they bring the ore to the surface and the higher the slenderness ratio the more props they can transport with the "cart" at any given time.

A need has thus been identified for a mine roof support overcoming at least some of the shortcomings of the above mine supports.

SUMMARY OF THE INVENTION

A yielding mine roof support is provided which is made in the form of a hollow tube made from an epoxy, phenolic, or polyester fibreglass composite.

The tube wall thickness may be between 1 mm and 15 mm.

The tube may taper over at least a portion of its extent. The tapered portion may be from 25 mm to 150 mm in length, typically from 50 mm to 100 mm in length.

The wall thickness of the tube may taper over at least a portion of its extent. This is believed to provide a gradual yielding characteristic.

The tapered portion may be located at and end zone of the tube.

The tapered portion may have at least a third less material than an untapered portion, typically at least 50% less material than an untapered portion.

The fibre orientation of the fibreglass may vary from 1 to 49% radial and the balance of the fibre orientation longitudinal for balancing between hoop strength and longitudinal tensile strength.

Carbon fibre reinforcement may be included in the fibreglass.

The total weight of the support may vary from 9 kg (for 1.5 m length) to 6 kg (for a 1 m length) for a support with yield design point at 40 tons.

The wall thickness may be proportional to the load that must be designed for and therefore the wall thickness of lower design load supports will be less than that of higher design loads.

The wall thickness for the epoxy resin composite support with a nominal 100 mm inner diameter with a design load of 15 ton may be 4.2 mm.

The wall thickness for the epoxy resin composite support with a nominal 100 mm inner diameter with a design load of 30 ton may be 8.3 mm.

The wall thickness for the epoxy resin composite support with a with a nominal 100 mm inner diameter design load of 40 ton may be 11 mm.

Where the support is made of epoxy resin composite a flame retardant may be added to the epoxy resin.

DESCRIPTION OF THE FIGURES

The invention will now be illustrated with reference to the accompanying Figures in which:

FIG. 2 shows photos before and after a yield test;

FIG. 3 shows the results of a test on a support without a taper;

FIG. 4 shows the result of a test on a support with a taper; and

FIG. 5 shows a 40 ton support of the invention.

DESCRIPTION OF THE EMBODIMENTS OF THE INVENTION

Experiments

Figure 1:
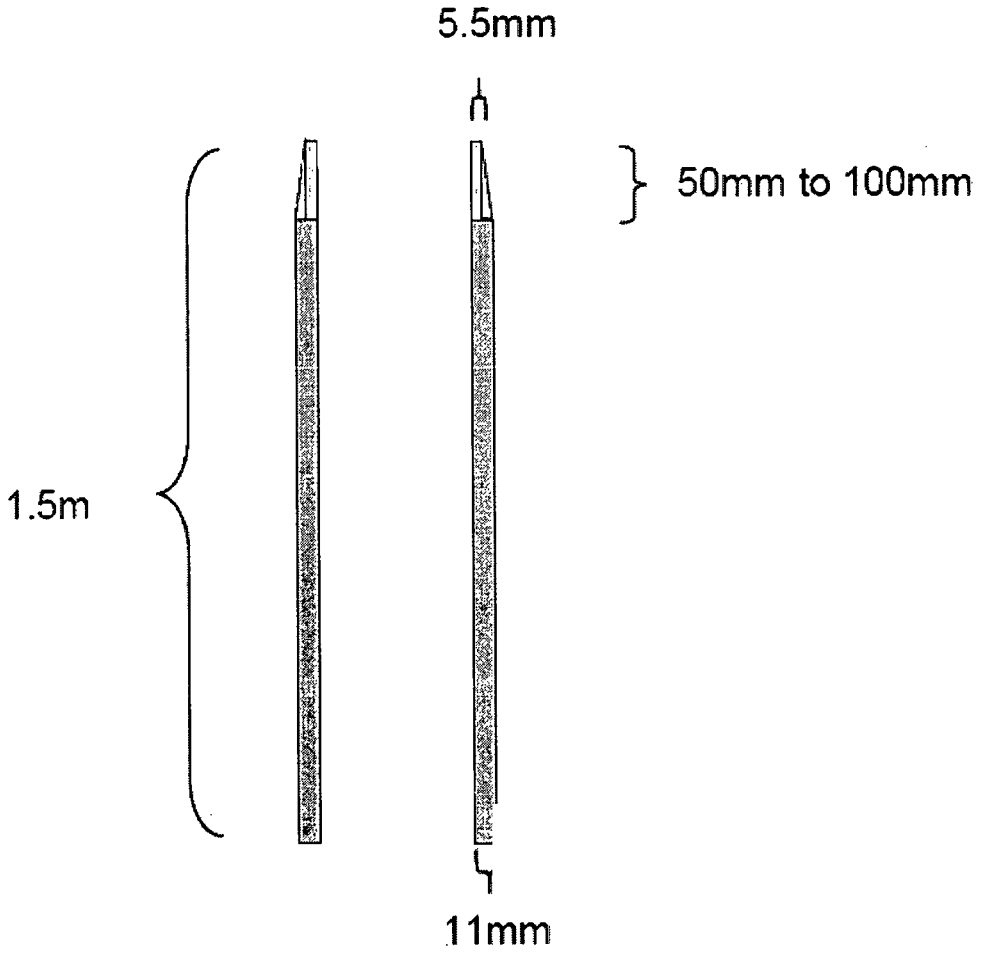
FIG. 1 shows a diagram showing the tapering of the mine roof support to ensure slow initial yielding of the unit when it reaches the design load of 40 ton.

The design specifically allows for yielding at one end of the support by tapering the one end of the support. See FIG.

1 for a design load of 40 ton. The taper is designed to ensure that a slow yielding process initiates when the support reaches its design load. The taper is machined post production and removes half of the wall thickness over a length of 50 mm to 100 mm.

The tapered design of the support allows for gradual yielding at one specific end. Please see FIGS. 3 and 4 for test results on a support (14 ton support with 4 mm wall thickness) without taper and support with taper. It is critical that a gradual load is maintained while the unit yields. FIG. 3 shows the initial drop in load unwanted from a yielding unit. FIG. 4 shows that the new tapered design of the invention removes initial drop in load.

Both graphs indicate a second sudden increase and drop in load. This carbon fibre reinforcement can be included (or not) to indicate that a certain yield distance has been reached.

The lessons learned on the 14 ton support tests were then implemented on a 40 ton support. See FIG. 5 for these test results. The variance of load while yielding is between 35 and 50 tons. This variance was decreased to 10 tons (varying between 40 tons and 50 tons) during subsequent tests. FIG. 5 shows the results for the new tapered design of the invention for a 40 ton support.

The wall thickness of an epoxy resin composite support of the invention is shown in the Table 1 below as a function of load design.

TABLE 1

Design load as a function of wall thickness (with a constant inside diameter of 100 mm)

| Design load | Wall thickness (mm) |
|---|---|
| 15 ton | 4.2 |
| 30 ton | 8.3 |
| 40 ton | 11 |

The inventor believes that the invention, as illustrated, provides a mine roof support which is an improvement over the described prior art above as the slenderness ratio of the current beam is also relatively high but the inventor has developed a fibreglass support with specific fibre orientation to prevent buckling of the support. The main aim was not to try and develop a prop to carry/support as high a possible load but to rather design an optimal support that is cost competitive and lighter weight compared to the current wood only support beams that is becoming scarcer and more difficult to source by the day.

The invention claimed is:

1. A yielding mine roof support, in a form of a hollow tube made from a composite selected from the group consisting of an epoxy fiberglass composite, a phenolic fiberglass composite, and polyester fiberglass composite, wherein a wall thickness of the hollow tube is between 1 mm and 15 mm, wherein a fiber orientation of the fiberglass along a length of the hollow tube is of from 1% to 49% radial orientation and wherein a balance of the fiber orientation is of a longitudinal orientation, wherein the fiber orientation is configured for balancing between hoop strength and longitudinal tensile strength, wherein the hollow tube tapers over at least a portion of the length of the hollow tube, wherein the tapered portion of the hollow tube is from 25 mm to 150 mm in length and is located at an end zone of the hollow tube, wherein a total weight of the support is from 9 kg for a 1.5 m length support to 6 kg for a 1 m length support, and wherein the yielding mine roof support is configured to support a load of a roof of a mine with a yield design point at 40 tons.

2. The yielding mine roof support of claim 1, wherein the tapered portion of the hollow tube is from 50 mm to 100 mm in length.

3. The yielding mine roof support of claim 1, wherein the tapered portion of the hollow tube has at least a third less material than an untapered portion.

4. The yielding mine roof support of claim 3, wherein the tapered portion of the hollow tube has at least 50% less material than an untapered portion.

5. The yielding mine roof support of claim 4, wherein a wall thickness of the hollow tube tapers over at least a portion of the length of the hollow tube, wherein the taper is machined post production.

6. The yielding mine roof support of claim 5, wherein the tapered portion of the wall thickness of the hollow tube is located at an end zone of the hollow tube.

7. The yielding mine roof support of claim 5, wherein the tapered portion of the hollow tube has at least a third less material than an untapered portion.

8. The yielding mine roof support of claim 7, wherein the tapered portion of the hollow tube has at least 50% less material than an untapered portion.

9. The yielding mine roof support of claim 1, wherein the tube wall thickness is proportional to a preselected load that the support is designed for, such that the tube wall thickness of a support designed for a lower load is less than the tube wall thickness of a support designed for a higher load.

10. The yielding mine roof support of claim 1, wherein the composite is epoxy resin composite, wherein the hollow tube has a nominal 100 mm inner diameter with a design load of 15 ton, and wherein the tube wall thickness is 4.2 mm.

11. The yielding mine roof support of claim 1, wherein the composite is epoxy resin composite, wherein the hollow tube has a nominal 100 mm inner diameter with a design load of 30 ton, and wherein the tube wall thickness is 8.3 mm.

12. The yielding mine roof support of claim 1, wherein the composite is epoxy resin composite, wherein the hollow tube has a nominal 100 mm inner diameter with a design load of 40 ton, and wherein the tube wall thickness is 11 mm.

13. The yielding mine roof support of claim 1, wherein the composite is epoxy resin composite, and wherein the composite further comprises a flame retardant.

14. The yielding mine roof support of claim 1, configured to avoid an initial spike and drop in load due to initial yielding.

15. The yielding mine roof support of claim 1, configured to yield initially without a sudden drop in load.

16. The yielding mine roof support of claim 1, wherein the hollow tube is seamless.

17. The yielding mine roof support of claim 1, wherein the hollow tube is a pillar structure.

* * * * *